US007527404B2

(12) United States Patent
Valois

(10) Patent No.: US 7,527,404 B2
(45) Date of Patent: May 5, 2009

(54) LIGHTING AND/OR SIGNALLING APPARATUS FOR A MOTOR VEHICLE

(75) Inventor: Christophe Valois, Wandignies Hamage (FR)

(73) Assignee: Valeo Vision, Bobigny (FR)

( * ) Notice: Subject to any disclaimer, the term of this patent is extended or adjusted under 35 U.S.C. 154(b) by 165 days.

(21) Appl. No.: 11/561,514

(22) Filed: Nov. 20, 2006

(65) Prior Publication Data

US 2007/0115678 A1 May 24, 2007

(30) Foreign Application Priority Data

Nov. 24, 2005 (FR) ..... 05 11909

(51) Int. Cl.
*F21V 7/00* (2006.01)

(52) U.S. Cl. ..... 362/517; 362/507; 362/516

(58) Field of Classification Search ..... 362/516–518, 362/507

See application file for complete search history.

(56) References Cited

U.S. PATENT DOCUMENTS

| | | | | |
|---|---|---|---|---|
| 4,740,871 | A * | 4/1988 | Dilouya | 362/518 |
| 5,692,824 | A * | 12/1997 | Ooishi | 362/505 |
| 5,967,647 | A | 10/1999 | Eichler | |
| 6,007,223 | A | 12/1999 | Futami | |
| 6,176,590 | B1 | 1/2001 | Prevost et al. | |
| 6,409,369 | B1 | 6/2002 | De Lamberterie | |
| 6,796,696 | B2 * | 9/2004 | Taniuchi | 362/539 |
| 6,893,148 | B1 | 5/2005 | Blusseau et al. | |
| 6,991,353 | B2 * | 1/2006 | Oyama | 362/517 |
| 7,186,009 | B2 | 3/2007 | Yamamura et al. | |
| 2003/0086277 | A1 * | 5/2003 | Hayakawa et al. | 362/513 |
| 2004/0027836 | A1 | 2/2004 | Takada et al. | |
| 2004/0042230 | A1 | 3/2004 | Obee et al. | |
| 2004/0170847 | A1 | 9/2004 | Lefevre et al. | |
| 2005/0057940 | A1 * | 3/2005 | Capello et al. | 362/507 |
| 2005/0117363 | A1 | 6/2005 | Yamamura et al. | |
| 2005/0174794 | A1 | 8/2005 | Kagiyama | |
| 2005/0248955 | A1 | 11/2005 | Nishizawa et al. | |
| 2006/0083014 | A1 * | 4/2006 | Kanzler et al. | 362/514 |
| 2006/0209556 | A1 * | 9/2006 | Tajima et al. | 362/516 |

FOREIGN PATENT DOCUMENTS

| | | |
|---|---|---|
| EP | 0 854 316 | 7/1998 |
| EP | 0 864 462 | 9/1998 |
| EP | 1 191 280 | 3/2002 |
| EP | 1 291 240 | 3/2003 |
| EP | 1724519 | 11/2006 |
| FR | 2 759 149 | 8/1998 |
| FR | 2 792 999 | 11/2000 |
| FR | 2 793 000 | 11/2000 |
| FR | 2 840 387 | 12/2003 |
| FR | 2 848 285 | 6/2004 |
| FR | 2863038 | 6/2005 |

* cited by examiner

*Primary Examiner*—Ali Alavi
(74) *Attorney, Agent, or Firm*—Jacox, Meckstroth & Jenkins

(57) ABSTRACT

An optical module for lighting and/or signalling apparatus for a motor vehicle, the optical module comprising at least one main reflector associated with at least one light source for emitting a main light beam. The optical module includes at least one supplementary reflective zone outside the main reflector and adapted to receive some of the light which comes directly or indirectly from the light source, and to reflect it so as to create a secondary light beam in a mean direction which is different from the mean direction of the main light beam.

19 Claims, 4 Drawing Sheets

Figure 2A:
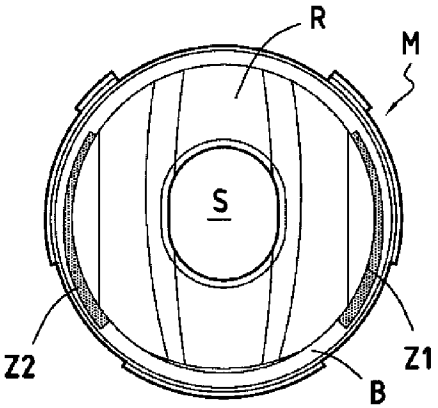
Figure 2B:
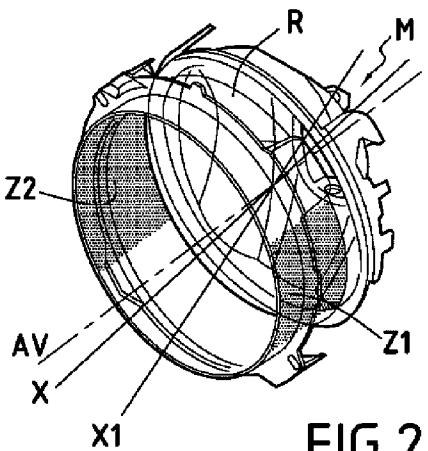
Figure 2C:
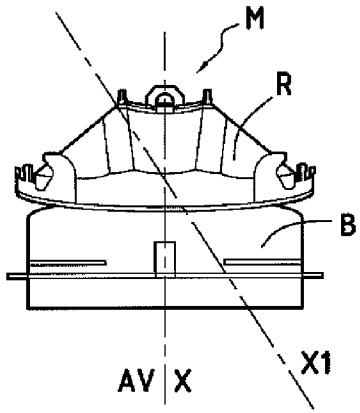
Figure 2D:
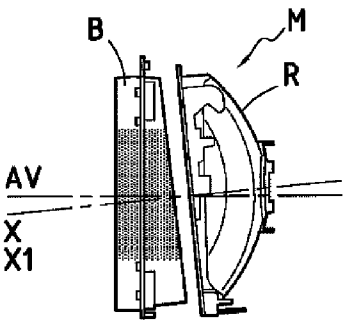

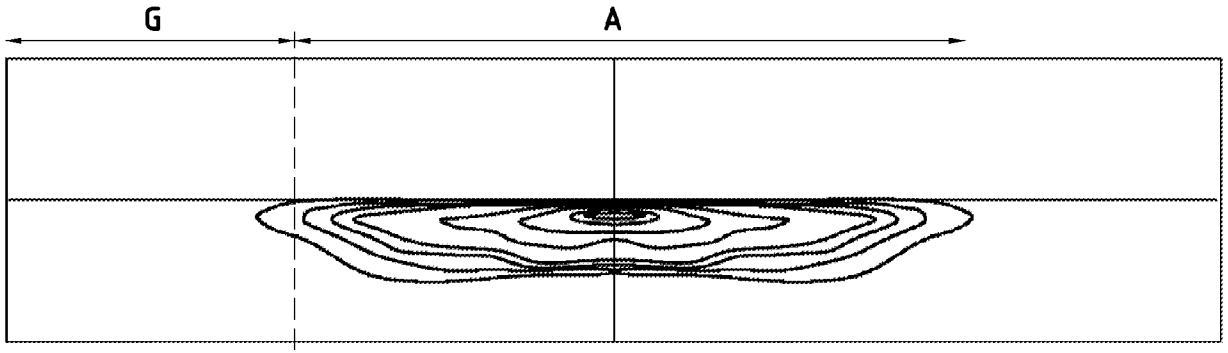
FIG.6
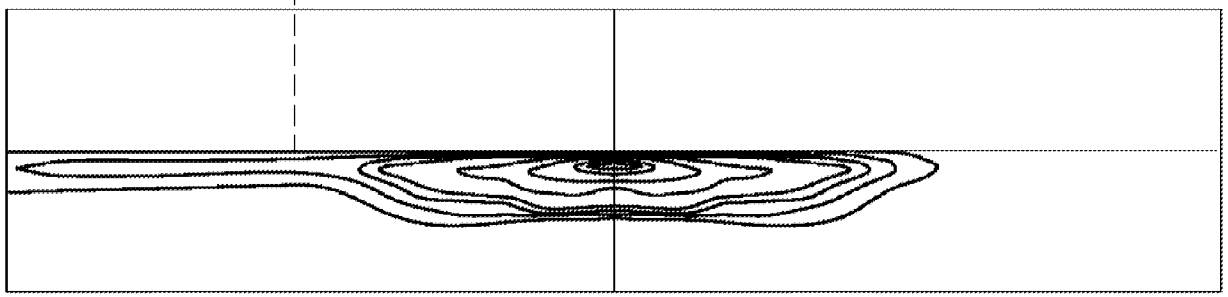
FIG.7
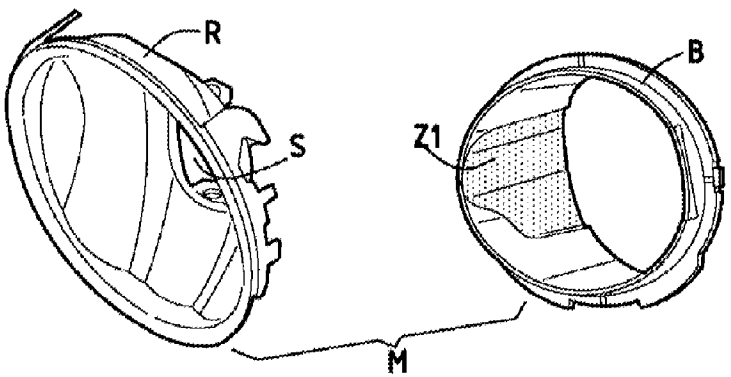
FIG.5A
FIG.5B

LIGHTING AND/OR SIGNALLING APPARATUS FOR A MOTOR VEHICLE

BACKGROUND OF THE INVENTION

This invention relates to lighting and/or signalling apparatus for a motor vehicle, and in particular to motor vehicle headlights.

1. Field of the Invention

More particularly, it relates to light beams for lighting to the side of the vehicle. This should be understood to mean light beams which give lighting in a general or mean orientation which is oblique with respect to the longitudinal axis X of the vehicle (this axis being generally collinear with, or little different from, the orientation of the optical axis of the other beams, or so-called main beams, emitted by the headlights).

2. Description of the Related Art

In the sense of the invention, and without any limitation, the light beams may be emitted by optical modules in order to provide, on bends, complementary lighting on the side into which the vehicle is turning. This function is called a "fixed bend light" function (FBL). It is for example described in patent No. EP 864 462. The FBL beam is accordingly associated with a standard beam of low beam type emitted by an optical module called the main module, so as to give a general beam having a wider angular aperture, the general beam being required to conform with a photometric grid which is defined in the current regulations for the functions known as advanced front lighting systems (AFS).

The invention may also relate to light beams which provide a lighting function of the kind known as "cornering", that is to say lighting on corners, the object of which consists in giving improved lighting to the side of the vehicle, not only in order to give the driver of the vehicle better visibility (the lighting function), but also to enable the vehicle itself to be discerned better from its surroundings (the indicating or signalling function). This function is, for itself alone, defined by a specific photometric grid which is provided in the current regulations.

The common point of these two types of beams, "cornering" and complementary FBL, is that it is necessary to achieve a sufficient supply of light along an axis which is oblique with respect to the longitudinal axis of the vehicle, which poses a certain number of problems, because headlights usually comprise one or several optical modules emitting light beams the optical axis of which is more or less coincident with the longitudinal axis of the vehicle. (An "optical module" is to be understood to mean an assembly of components which comprises at least one reflector, with its associated light source or sources and, if applicable, associated optical elements such as dioptric elements, Fresnel lenses and so on, adapted to emit at least one given light beam).

A first solution consisted in turning, inside the headlight, the module which is adapted to light up towards the side with respect to the other optical modules: the headlight retains its usual configuration, with its main modules, for example the one emitting the low beam or the high beam, while the complementary FBL or "cornering" module is turned in such a way that its optical axis makes an angle with the optical axis of the other modules.

This solution does however have its limits; a module turned in this way takes up more space inside the headlight in which, in particular, lamp connecters are disposed obliquely and the reflector occupies more space. Compactness is now being demanded more and more in a headlight. In addition, to turn a module in this way does tend to involve a loss of light flux emitted by the module: the most oblique rays tend not to be able to emerge from the cover lens of the headlight. Therefore, following the form of the headlight, the amplitude of rotation of the module is accordingly limited to a greater or lesser extent, and it is difficult to guarantee that the beam emitted by the module and effectively leaving the headlight is fully compatible with the current regulations.

There is, therefore, a need to overcome one or more problems of the prior art by providing an improved lighting and/or signalling apparatus.

SUMMARY OF THE INVENTION

An object of the invention is therefore to remedy the disadvantages of this first solution, by proposing, in particular, a new design of module giving sideways lighting which will, in particular, be easier to make, have better performance, or again be less restricted as to the design of the module and/or of the headlight that includes the module concerned.

The optical module in accordance with the invention is adapted for equipping a lighting and/or indicating apparatus for a motor vehicle. It comprises at least one main reflector which is associated with at least one light source for emitting a main light beam. It also includes at least one supplementary reflective zone, which is outside the main reflector and which is adapted to receive some of the light coming directly or indirectly from the light source, and to reflect it in such a way as to create a secondary light beam in a mean direction which is different from the mean direction of the main light beam.

In this way some of the light which is to form a given beam (the so-called main beam) is to some extent made use of in order to create a further beam (called the secondary beam) having a different orientation, this use being fashioned in such a way that it does not adversely affect the optical performance, photometry and distribution of the main beam. This result can be achieved by, for example, making use of the light in the part of the main beam which is least useful photometrically, and/or by recuperating some light which would otherwise have been lost.

This solution has a number of advantages, some of which are the following:

- recourse is only to had a single light source to produce two different light beams, and in this way it is possible to preserve standard light sources without making it necessary to use a specific second source (nor all its accessories, in particular without any supplementary electrical beam),
- the usual orientation of the optical module along the longitudinal axis of the vehicle is able to be preserved, which is relevant in terms of compactness of the product,
- the module is able to preserve in a substantially standard way the design of the main reflector which is dedicated to the provision of a given main beam, by adding the appropriate supplementary reflective zone in order to have the desired secondary beam,
- it is therefore possible to provide a plurality of optical modules which have a substantially identical main beam with the same reflector, and which can produce a plurality of possible secondary beams to adapt the module to demand, in accordance with the configuration of the supplementary reflective zone, which gives the module increased flexibility, and
- it is therefore possible to give a new function to an existing optical module without entirely revamping its optical and mechanical design.

The fact that the supplementary reflective zone is outside the main reflector means it can be adjacent and close to the reflector, but it is not an integral part of the latter, and this, as mentioned above, enables the main reflector to be standardized.

The distance between the supplementary reflective zone and the optical axis is preferably greater than or equal to the distance between the edges of the main reflector and the optical axis. That is to say that, for each point of the supplementary reflective zone, the shortest distance from this point to the optical axis is preferably greater than or equal to the shortest distance between the edges of the main reflector and the optical axis.

The supplementary reflective zone is preferably adapted to receive some of the light that comes only directly from the light source. "Direct light from the light source" or "coming directly from the light source" are to be understood to refer to the rays emitted by the light source which have not been reflected beforehand. On the other hand, the expression "light coming indirectly from the light source" is to be understood to refer to those rays which have been reflected beforehand at least once after having been emitted by the light source.

The term "optical module" is to be understood to mean an assembly of components which include at least one reflector and a light source, and which can either be a lighting element in unitary form, such as an anti-fog module independent of the headlight of the vehicle, or a component which is adapted to be integrated into a headlight.

The mean direction of the main light beam may be arranged to be along its optical axis. This axis may or may not be coincident with the longitudinal axis of the vehicle that is equipped with the apparatus according to the invention: it may be effectively coincident or, for example, it may be slightly inclined in a plane that is substantially vertical and/or horizontal with respect to the longitudinal axis of the vehicle. For example, where the main beam is of an anti-fog type, its optical axis can be slightly inclined, by 0.5 to 2° vertically and by 0 to 15° horizontally, especially by 5 to 10°.

A mean direction "different" from the mean direction of the main light beam was mentioned above. This angular difference between the two beams, main and deviated, is preferably significant, and is preferably at least 10°, being in particular in the range between 25° and 70° and most particularly between 30° and 60°. This range preferably exists in a substantially horizontal plane, although the invention also includes a difference in orientation having both a component in the horizontal plane and a component in a vertical plane.

The secondary beam preferably has a distribution in the range from 0 to 90°. The term "distribution" is to be understood here to mean the angle between the ray of the secondary beam which makes the smallest angle with the optical axis of the optical module, and the ray of the secondary beam that makes the largest angle with the optical axis of the optical module.

The supplementary reflective zone preferably enables 5 to 10% of the light flux coming directly from the light source to be reflected sideways.

The secondary beam is preferably sufficient to generate lighting in such a way that it is not necessary to make use of a convergent lens or other optical means for enabling the direction or distribution of the rays reflected by the supplementary reflective zone to be changed. More particularly, the present invention may be adapted for headlights in which the optical module, consisting of a lamp and a reflector, has no lens.

In one embodiment of the invention, the main light beam is a beam having no cut-off, of the high beam type, or a beam with a cut-off, and in particular an oblique cut-off, such as a low beam, or again one with a flat cut-off such as an anti-fog beam.

In another embodiment, which may be combined with the above embodiment, the secondary light beam is a beam with a cut-off, and in particular a complementary beam the function of which is that of a fixed bending light or a beam giving a sideways lighting function of the kind called "cornering".

In a preferred embodiment of the invention, the supplementary reflective zone is disposed in such a way that the secondary light beam lights a supplementary zone of lighting, which extends over a large enough width, outside the zone lighted by the main light beam, to permit sideways lighting, and thereby to enable a side lighting function of the "cornering" type to be obtained.

When it is desired to obtain sideway lightings, the angular difference between the mean directions of the two beams is preferably about 45°, and the distribution of the secondary beam is preferably in the range from 30 to 60°.

Preferably, though not necessarily, the main beam on the one hand and secondary beam on the other hand are beams with a cut-off, having in particular the same type of cut-off, whether flat or oblique.

In a first modified embodiment, the optical module has only one supplementary reflective zone. In this way a module is obtained for equipping the front right hand side of the vehicle with a given supplementary reflective zone, and a module for equipping the front left hand side of the vehicle with a reflective zone which is positioned differently in the module from the corresponding zone in the right hand module.

In a second modified embodiment, the optical module includes at least two supplementary reflective zones, in particular two zones which are disposed symmetrically with respect to the main reflector. This variant offers the advantage that it has modules which can be adapted differently for the right and left hand sides of the vehicle, which simplifies production and warehousing of the modules: a common optical element is used whether the module is intended for a right hand drive headlight or a left hand drive headlight, and whether the module is intended to be integrated in a headlight or to be an independent unit.

Preferably, the or each supplementary reflective zone is integrated in a styling member of the module. The term "styling member" is to be understood to mean any component which decorates the optical modules and, for example, provides surface continuity between the modules and the walls of the casing or junction zone between the casing and the closure lens.

These styling members therefore have a cosmetic function, and it is generally desired that they shall have no, or as little as possible, optical impact on the light beams emitted by the module. They can be partly integrated in the module, in particular where the module is a unitary product, such as an anti-fog module for example. They can also be associated, in contact with the modules, and form part of the headlight in which the module is to be incorporated.

In this way, a styling member is modified locally so that it is able, despite its function, to take part in the optical definition of a light beam.

The integration of the supplementary reflective zone or zones in the styling member may be carried out in different ways. For example, the styling member may be locally modified superficially. It is also possible to insert the reflective zone into a styling member in the form of an insert piece which is fastened to the member by any suitable mechanical means (such as clipping etc.), or by adhesive bonding.

The supplementary reflective zone(s) is disposed in the bezel of the module which at least partly surrounds the main reflector, or which forms an integral part of the bezel, or is disposed close to the bezel. The term bezel means the styling member that provides surface continuity between the reflector and the remainder of the module (or of the headlight).

The bezel is preferably substantially reflective locally so that the required supplementary reflective zone or zones is or are obtained, and is substantially diffusing or absorbing over the rest of its visible surface. The bezel may be made diffusing by making it grainy, the supplementary reflective zones being aluminized but not grainy.

In practice it is possible to make a fully aluminized bezel, which is therefore initially entirely reflective, and then to treat the visible parts of the bezel so as to make them diffusing or absorbing except in those zones which have to be reflective in accordance with the invention. The reverse process is also possible, having a bezel the visible surface of which is initially entirely made diffusing or absorbing, with certain reflective zones then being created locally (for example by selective aluminizing). It is again possible, as mentioned above, to provide a "window" in the bezel in which a reflective insert is fixed, or a zone which is then overlaid with a reflective insert.

Especially where it is necessary to have perfect control of the characteristics of the secondary beam, it is useful not only to make a zone of the styling member or bezel reflective, but also to modify the relief of the member in the zone: the zone preferably has a geometric form which is designed to provide the required photometry. In order to ensure surface continuity with the remainder of the styling member, it is then possible to consider that the supplementary reflective zone has a central portion which is optically defined as a reflector, together with a peripheral portion which is a junction zone with the rest of the member. The zone, at least in that central portion, can thus include a plurality of facets, in particular having a plurality of focal lengths. This modification of geometry in the styling member, apart from the modification of appearance, can also play a part in a styling effect of interest.

The main reflector is for example of a type having a free surface, or of a type with parabolic generatrices, or of an elliptical type.

The invention is also directed to a headlight equipped with at least one of the optical modules, and to a motor car equipped with one of the modules, by themselves or integrated in a headlight.

These and other objects and advantages of the invention will be apparent from the following description, the accompanying drawings and the appended claims.

The invention will be described below with reference to non-limiting examples which are illustrated in the following Figures of the drawings.

BRIEF DESCRIPTION OF THE ACCOMPANYING DRAWINGS

Figure 1A:
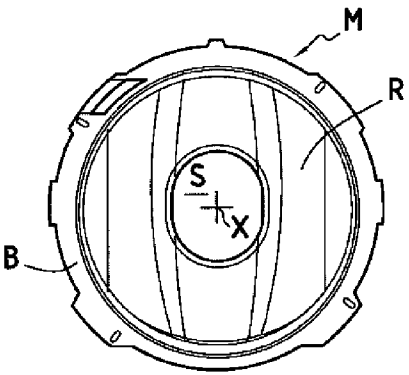
Figure 1B:
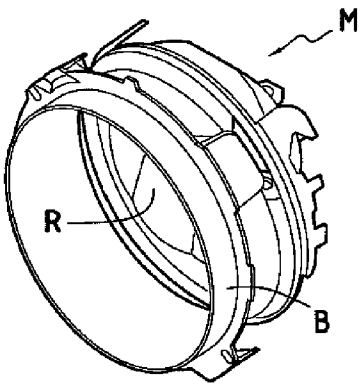
Figure 4:
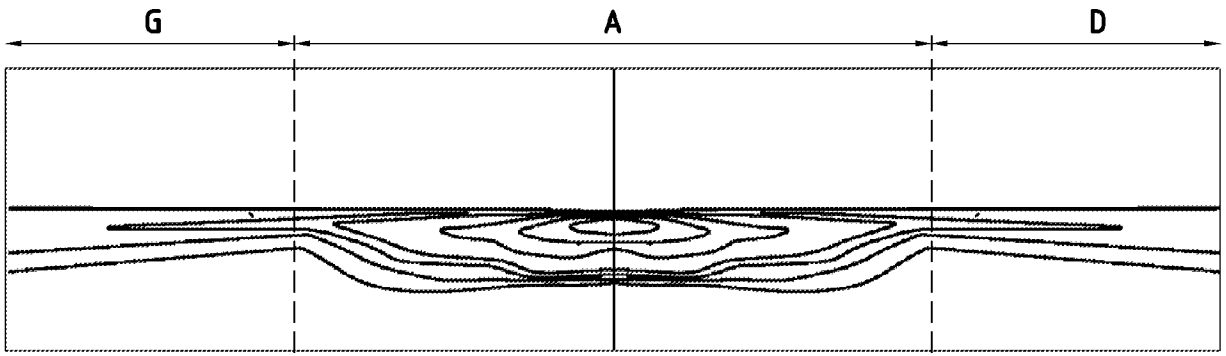
Figure 3:
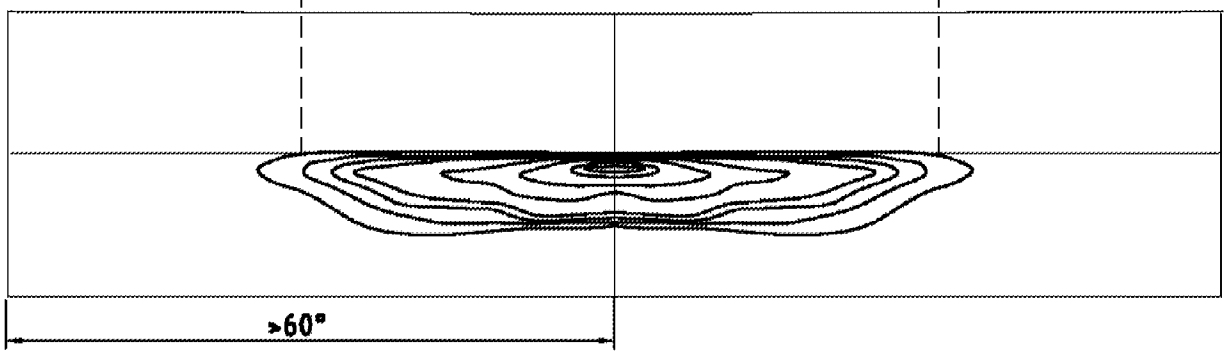
Figure 8:
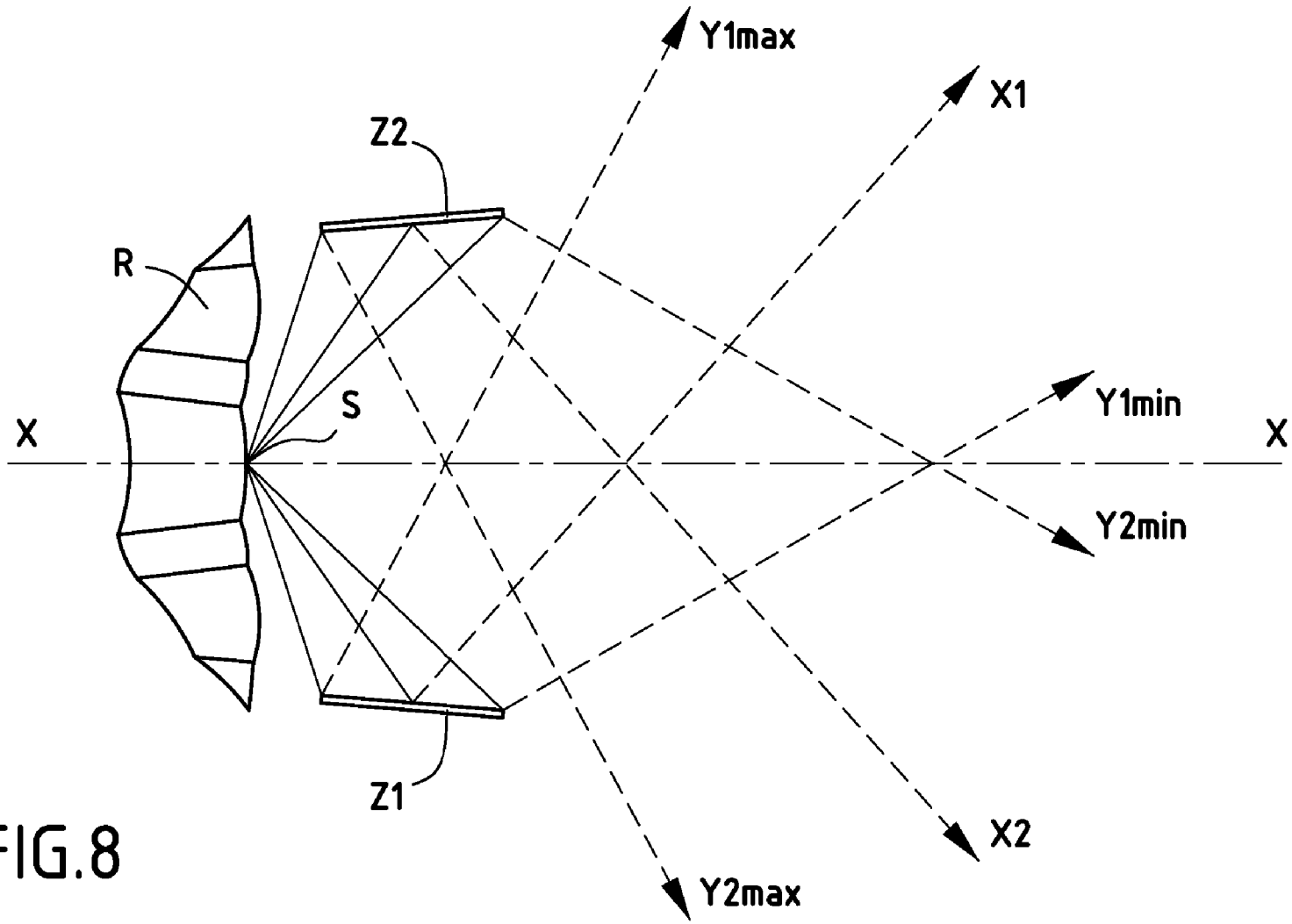

FIGS. 1A and 1B illustrate a front view and an exploded perspective view, of an optical anti-fog module in accordance with the prior art (comparative example 1), FIGS. 2A, 2B, 2C and 2D illustrate a front view, an exploded perspective view, a top plan view and a side view of an optical anti-fog module modified in accordance with the invention so as also to produce a "cornering" beam (example 1), FIG. 3 is a representation of the isolux curves of the anti-fog beam and the "cornering" beam with the module of example 1, FIG. 4 is a representation of the isolux curves for the anti-fog and "cornering" beam with the module of example 1, FIGS. 5A and 5B illustrate an exploded perspective view of another optical anti-fog module, modified in accordance with the invention so as also to produce a "cornering" beam (example 2), FIG. 6 is a representation of the isolux curves for the anti-fog beam with the module of example 2, before being modified in accordance with the invention (comparative example 2), FIG. 7 is a representation of the isolux curves for the anti-fog beam and the "cornering" beam with the module of example 2, and FIG. 8 is a diagrammatic representation of an optical anti-fog module modified in accordance with the invention, and the trajectory of rays which constitute the "cornering" beam, taken on a horizontal cross section passing through the optical axis of the module.

All of the Figures of the drawings are diagrammatic, and they are not necessarily to scale. Not all of the components are shown, but only those which have direct relevance to the invention, so as to make the drawings easier to read.

COMPARATIVE EXAMPLE 1

Prior Art

FIG. 1 shows in perspective an optical module M which includes a reflector R and a light source S, which may be of the halogen type or the xenon lamp type (not shown in the drawing). In the present case, by way of example, it is a lamp of the H11 halogen type. The reflector R is of the type having a free surface defined in such a way as to generate a beam with a flat cut-off, of an anti-fog beam type. For more details as to how to obtain such a beam, reference can with advantage be had to patents FR 02 793 000 and FR 2 792 999.

The module M also includes a styling member, or so-called bezel, B which will provide surface continuity between the outer edge of the reflector R and the edge of the lens which closes off the module (not shown), and which is substantially cylindrical so as to be adapted to the external contour of the reflector. The bezel is aluminized and has ribs s, which have two purposes: to give a particular style to the module and to ensure that parasitic rays coming from the reflector and reaching the bezel will be diffused in such a way as to avoid any accidental dazzling by parasitic reflection at its surface of light rays coming either from the reflector or directly from the light source. The bezel could also be chosen not to be aluminized, and to have an appearance which is matt, or black or grey for example, at the same time making it at least partly absorbent.

EXAMPLE 1

According to One Illustrative Embodiment of the Invention

FIG. 2 shows the foregoing module modified in accordance with the invention. The reflector R and light source S are retained unchanged, but the bezel is modified in such a way that it has two zones Z1 and Z2 which are disposed laterally (with reference to the module as fitted in the vehicle), symmetrically with respect to the optical axis X defined by the main reflector R. These zones enable a beam of the "cornering" type to be obtained in superimposed relationship with the anti-fog beam. Each of these zones is aluminized, like the rest of the bezel, but is not diffusing or absorbing: the geometry of the zone Z1 is so calculated that any light rays coming either directly from the light source S or coming from the reflector R and reaching this zone leaves it again along a mean axis X1 which makes an angle of about 45° with the axis X, and which may be chosen in the range between 30° and 60° in the most common configurations.

It should also be noted that the optical axis X is inclined with respect to the longitudinal axis AV of the vehicle.

Similarly, the zone Z2 is calculated in such a way that the rays that reach it will be deflected and will leave it along a mean axis X2 which is symmetrical with the axis X1 with respect to the optical axis X. The surfaces Z1 and Z2 include a succession of facets, in which each facet has its own focal length. This type of module is the same for both the right hand side and left hand side: only one of the zones 21 or 22 is effective as regards the "cornering" function for each of the modules.

FIG. 8 enables the mean directions X1 and X2 of the secondary beams, and their distribution, to be seen. Thus, Y1 max corresponds to the direction of the light ray which has the greatest angle with respect to the optical axis X, while Y1 min corresponds to the direction of the light ray having the smallest angle with respect to the optical axis X. The secondary beam generated by the reflective zone Z1 therefore extends between Y1 min and Y1 max, and is emitted generally in the mean direction X1. The preferred example shown in FIG. 8 corresponds to lighting with a "cornering" function. The angle between Y1 min and X is about 30°, while the angle between Y1 max and X is about 60°. The angle between the mean direction X1 and the optical axis X is about 45°. It may be equally observed that the secondary beam generated by the reflective zone Z2 is emitted in the mean direction X2, with the angle between X2 and X being about 45°, and extends between Y2 min and Y2 max, that is to say between about 30° and 60° with respect to X.

FIGS. 3 and 4 enable the distribution of the light beams obtained to be compared: they are representations of isolux curves measured at about 25 meters.

FIG. 3 corresponds to comparative example 1: here there is a distribution of an anti-fog beam with a flat cut-off and a total measured flux of 370 lumen.

FIG. 4 corresponds to example 1 according to one embodiment of the invention: the central zone of lighting A corresponds to the zone lit up by the main beam. The left hand zone G and right hand zone D correspond to the zones lit up by the secondary beams which are generated by Z2 and Z1, respectively. It can be seen that the distribution of the beam is severely spread, relatively symmetrically on either side of the beam of origin in accordance with FIG. 3, and that the cut-off remains flat. The total flux measured is 430 lumen.

Minimum values of the "cornering" beam, defined in accordance with the standard ECE R110, namely a point 2.5D60L with a minimum of 240 candelas, a point 2.5D45L of 400 candelas minimum, and a point 2.5D30L of 240 candelas minimum. The spreading effect gives a "cornering" function on only one side, which is the left hand side if what is being considered here is a right hand fog light of a vehicle (indicated diagrammatically by the arrow in FIG. 4), and the part on the right hand side (i.e. on the nearside of the vehicle) contributes to the anti-fog beam. It is relevant to note that the total measured flux is raised by a significant amount, and that the photometric characteristics of the anti-fog beam per se are not affected by the modification of the bezel. From this it follows that the invention enables a "cornering" function to be obtained at reduced cost and without a supplementary lamp, and that this function can in addition be obtained with no detriment to the main function.

The gain in light flux demonstrates that the "cornering" function results at least partly from the recuperation of light rays which, in the absence of this arrangement, would be "lost" in the region of the bezel. In this way a considerable improvement is obtained in the output of the lamp, everything else being equal.

EXAMPLE 2

According to One Illustrative Embodiment of the Invention

As shown in FIG. 5, the optical module here is of an anti-fog type of a design which is a little bit different from example 1: the light source S is a halogen lamp of the H11 type, the reflector R being of a free surface type. The bezel B, which has been fixed on the perimeter of the reflector, is ribbed (or it may alternatively have a grainy surface). It also has a supplementary reflective zone Z1, the form of which is substantially parabolic, with its surface being aluminized. FIG. 6 shows the isolux lines of the module when the bezel does not have the reflective zone Z1 (comparative example 2), while FIG. 7 shows the isolux lines in accordance with example 2. It can be seen that zone Z1 enables a beam to be obtained that retains its flat cut-off and is "spread" on one side, in other words there is a spreading into the zone G situated on the left hand side of the central zone A.

The points of measurement of the "cornering" beam in accordance with the standard SAE J852 are the minimum levels required, and these are largely obtained by example 2 as shown in the following table of measurements.

| | Measurement points | | |
|---|---|---|---|
| | 2.5D60L | 2.5D45L | 2.5D30L |
| Required minimum | 300 cd | 500 cd | 300 cd |
| Measured values | 350 cd | 770 cd | 1400 cd |

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An optical module adapted for equipping a lighting and/or signalling device for a motor vehicle, said optical module comprising: at least one main reflector associated with at least one light source for emitting a main light beam, wherein said optical module includes at least one supplementary reflective zone, which is outside said main reflector and which is adapted to receive some of the light coming directly or indirectly from said at least one light source, and to reflect it in such a way as to create a secondary light beam in a mean direction which is directed away from said mean direction of said main light beam by an angle of at least 30° to provide sideways lighting outside the motor vehicle to facilitate illumination of an area to a side of the motor vehicle where the motor vehicle is being directed or is turning.

2. The optical module according to claim 1, wherein said at least one supplementary reflective zone is integrated in a styling member of the optical module.

3. The optical module according to claim 1, wherein said at least one supplementary reflective zone is disposed in such a way that said secondary light beam lights a supplementary zone of lighting, which extends over a sufficiently great width outside a main beam zone lighted by said main light beam to enable sideways lighting of the "cornering" type to be obtained.

4. The optical module according to claim 1, wherein said at least one supplementary reflective zone is disposed in a bezel of the optical module which at least partly surrounds said main reflector, or which forms an integral part of said bezel, or is disposed close to said bezel.

5. The optical module according to claim 4, wherein said bezel is substantially reflective locally so that said at least one supplementary reflective zone is obtained, and is substantially diffusing or absorbing over the rest of its visible surface.

6. The optical module according to claim 1, wherein said main light beam is a beam having no cut-off, or a beam with a cut-off, in particular one with an oblique cut-off or a flat cut-off, for example, a low or anti-fog beam.

7. The optical module according to claim 1, wherein said secondary light beam is a cut-off beam, in particular a complementary beam with a fixed bending light beam function or a beam which provides a lateral, so-called "cornering", lighting function.

8. The optical module according to claim 1, wherein it has at least two supplementary reflective zones, in particular two zones which are disposed symmetrically with respect to said main reflector.

9. The optical module according to claim 1, wherein said at least one supplementary reflective zone is adapted to receive some of the light that comes only directly from said at least one light source.

10. The optical module according to claim 1, wherein the distance between said at least one supplementary reflective zone or zones and the optical axis of said optical module is greater than or equal to the distance between the edges of said main reflector and said optical axis.

11. The optical module according to claim 1, wherein said at least one supplementary reflective zone has a plurality of facets, having, in particular, a plurality of focal lengths.

12. The optical module according to claim 1, wherein said at least one main reflector is of a type having a free surface, or of a type with parabolic generatrices of said at least one main reflector, or of an elliptical type.

13. A motor vehicle headlight including at least one said optical module according to claim 1.

14. An optical module adapted for equipping a lighting and/or signalling device for a motor vehicle, said optical module comprising: at least one supplementary reflective area adapted to receive at least one main light source and to reflect it in such a way as to create a secondary light beam along an angle that is oblique relative to the optical axis of said optical module, said at least one supplementary reflective area being located outside a reflector of said optical module, said secondary light beam being directed away from at least one main light beam by an angle of at least 30° to provide sideways lighting outside the motor vehicle to facilitate illumination of an area to a side of the motor vehicle where the motor vehicle is being directed or is turning.

15. The optical module according to claim 14, wherein said at least one supplementary reflective zone is disposed in a bezel of the optical module which at least partly surrounds a main reflector, or which forms an integral part of said bezel, or is disposed close to said bezel.

16. The optical module according to claim 14, wherein said secondary light beam is a cut-off beam, in particular a complementary beam with a fixed bending light beam function or a beam which provides a lateral or cornering lighting function.

17. The optical module according to claim 14, wherein said at least one supplementary reflective area comprises a first area and a generally opposed second area.

18. The optical module according to claim 17, wherein said first area and said generally opposed second area lie in a generally cylindrical plane.

19. The optical module according to claim 18, wherein said first area and said generally opposed second area are each aluminized.

* * * * *